United States Patent [19]

Applegate, Jr.

[11] 4,424,904

[45] Jan. 10, 1984

[54] ROTARY DISPLAY RACK PARTICULARLY ADAPTED FOR STORING RECORD ALBUMS

[76] Inventor: Quentin Applegate, Jr., 10 Koster Blvd., Apt. 7B, Edison, N.J. 08837

[21] Appl. No.: 265,543

[22] Filed: May 20, 1981

[51] Int. Cl.[3] ..... A47B 41/04; A47G 29/00

[52] U.S. Cl. ..... 211/40; D6/185; 108/94

[58] Field of Search ..... 211/40, 163, 194, 189, 211/205, 53; 108/94; 312/11; D6/185, 20, 85

[56] References Cited

U.S. PATENT DOCUMENTS

| | | | |
|---|---|---|---|
| D. 263,665 | 4/1982 | Anderson | D6/185 |
| 1,137,900 | 5/1915 | Reichert | 211/163 |
| 3,170,741 | 2/1965 | Richards, Jr. | 211/40 X |
| 3,214,029 | 10/1965 | Jack | 211/40 |
| 3,341,266 | 9/1967 | Schecter et al. | 211/40 X |
| 3,608,739 | 9/1971 | Duboff | 211/40 |
| 4,232,790 | 11/1980 | Serrano | 211/40 |
| 4,270,461 | 6/1981 | Schramm | 211/40 X |

FOREIGN PATENT DOCUMENTS

| | | | |
|---|---|---|---|
| 1529797 | 5/1968 | France | 211/40 |

*Primary Examiner*—Francis K. Zugel
*Assistant Examiner*—Peter A. Aschenbrenner
*Attorney, Agent, or Firm*—Arthur L. Plevy

[57] ABSTRACT

There is disclosed a rotary rack for storing record albums. The rack has a turntable rotatably mounted on a support base. Extending vertically from the center of the turntable is a cylinder. The cylinder has pairs of associated apertures located about the periphery near the top. A rod is inserted through a pair of apertures to effectively divide the turntable into a series of wedge like compartments. Located about the surface of the turntable are extending posts to maintain the position of a stack of albums standing on their edges and retained between the rods and posts forming the compartments.

10 Claims, 6 Drawing Figures

ROTARY DISPLAY RACK PARTICULARLY ADAPTED FOR STORING RECORD ALBUMS

BACKGROUND OF INVENTION

This invention relates to a rotary display rack and more particularly to a rotary display rack adapted to store and hold record albums.

The prior art is replete with various patents which serve to store or hold record albums and other flat articles in a convenient and accessible manner.

The purpose of such devices and apparatus is to allow owners of large record collections to locate the album of their choice as conveniently as possible.

U.S. Pat. No. 2,690,843 entitled DISPLAY STAND issued on Oct. 5, 1954 to W. D. Ament. This patent shows a rotatable record holder which uses a complicated bracket for holding each record.

U.S. Pat. No. 2,899,076 entitled DEVICE FOR HOLDING FLAT ARTICLES OR THE LIKE issued on Aug. 11, 1959 to H. R. Gullikson and depicts a rotary record holder which provides separate slots for each record.

U.S. Pat. No. 3,092,256 entitled PHONOGRAPH RECORD RACK issued on June 4, 1963 to D. Vernick and shows a rotary record holder which holds individual records or albums in separate brackets.

U.S. Pat. No. 3,170,741 entitled DEVICE FOR STORING FLAT ARTICLES depicts a rotary record holder which employs strings or wires to form separate compartments for holding a record album.

U.S. Pat. No. 3,214,029 entitled RECORD HOLDER issued on Oct. 26, 1965 to C. A. Jack and depicts a rotary record holder where the edges of records are retained in end grips for each record.

U.S. Pat. No. 3,341,266 entitled ROTARY STORAGE CABINET issued on Sept. 12, 1967 to D. Schecter et al and shows a rotary device having upstanding "V" shaped rods to form record holding partitions.

In spite of these and other devices there is a need for an improved and reliable display rack which can hold in excess of one hundred record albums and which device is easy to use, manufacture and assemble, as well as being economical. In this manner the display rack can be used by a great number of individuals for storing flat articles such as record albums in an efficient and economical manner.

BRIEF DESCRIPTION OF THE PREFERRED EMBODIMENT

A rotary display rack for storing record albums or flat articles comprises a base with a turntable rotatably carried by the base, the turntable has a vertically extending central cylinder, the cylinder has pairs of apertures located about the periphery thereof, each pair accommodates an elongated rod to effectively divide the turntable into wedge-like compartments. The surface of the turntable has located thereon posts for further forming each compartment and to provide a bottom support surface for the stack of albums which are retained within each compartment as supported by the rods at the top and by the posts at the bottom.

DETAILED DESCRIPTION OF FIGURES

Figure 1:
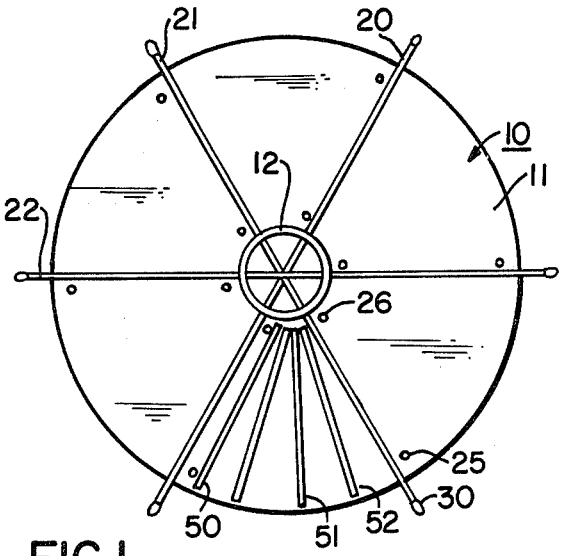
FIG. 1 is a top plan view of a rotary display rack according to this invention.

Referring to FIG. 1, there is shown a top plan view of a rotary display rack 10 according to this invention. As will be explained, the rack 10 has a circular planar turntable 11. The turntable 11 has a vertically extending cylinder 12 affixed about the center. As can be seen from FIGS. 1 and 2, the cylinder 12 is a longitudinal tubular member and extends in the vertical plane. The cylinder 12 has an opened top and an opened bottom. Located at the center of the turntable is a circular hub 14. The opened bottom of the cylinder 12 is implaced over the hub 14. Essentially the diameter of the hub 14 is slightly smaller than the inner diameter of the cylinder 12 and hence a force fit may hold the cylinder rigidly to the turntable. In any event, the cylinder can be secured to the hub 14 by means of a suitable fastener located in aperture 15.

Located about the periphery of the cylinder 12 near the top end are three pairs of apertures, as for example, 16 and 17. Each aperture is located along the diameter of the cylinder and a rod is inserted through each pair of apertures.

As shown in FIG. 1, there are three rods 20, 21 and 22 inserted through the corresponding apertures in the cylinder. Each rod is an integral unit fabricated from a strong metal or plastic and has a length greater than the diameter of the turntable. In this manner, a portion of the rod seen from FIG. 1 projects beyond the periphery of the turntable and serves as a handle to aid in rotating the rack 10 when it is accommodating record albums or other articles.

Located on the surface of the turntable and relatively proximate to each rod sections are pairs of upstanding posts as 25 and 26. As can be seen from FIG. 1, each section of the rod as extending through the cylinder is associated with a back post as 26 located near the periphery of the cylinder and a front post as 25 located near the periphery of the turntable. Thus, as seen in FIG. 1, the three rods are equally spaced and form six wedge-like compartments with each compartment further having a pair of posts as 25 and 26.

Figure 2:
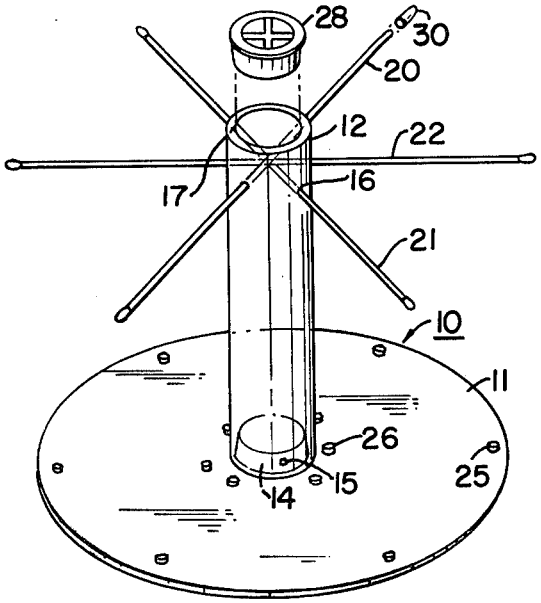
FIG. 2 is a perspective plan view of the rack.

As seen in FIG. 2, the cylinder has an opened top into which may be inserted a closure member or cap 28. Based on the structure of the device, each compartment can hold 20 or more record albums such as those of the long play (LP) types. The albums are positioned in an upstanding relation and hence rest on their edges as shown in FIG. 1. The stack of albums is supported at the bottom by the posts 25 and 26 and at the top by the rods.

As seen in FIG. 1, the record albums such as 51 and 52 are positioned so that they are standing on their edges and are directed from the back post 26 to the front post 25. Due to the wedged shape of each compartment the record albums flare outwardly and hence are closely spaced about the periphery of the central cylinder 12 and spaced further apart near the peripherial edge of the turntable. In this manner, a user can immediately recognize each album as the spacing and positioning allow the user to see the album face as can be discerned from FIG. 1.

As shown in FIG. 2, the entire unit can be assembled and disassembled very rapidly. Thus as seen, the cylinder 12 is implaced upon the hub 14. The rods 20 to 22 are inserted through the apertures by the consumer who then may implace rubber tips as 30 at each end. The cap member 28 is then inserted. In a similar manner the posts 25 and 26 are conventional tacks which have enlarged plastic heads and which are widely available and used for bulletin boards and similar applications. Thus, each post is inserted as shown in FIG. 2 by the consumer. It is of course understood that the posts may be integrally formed or separately attached to the surface of the turntable during the manufacturing procedure.

Figure 3:
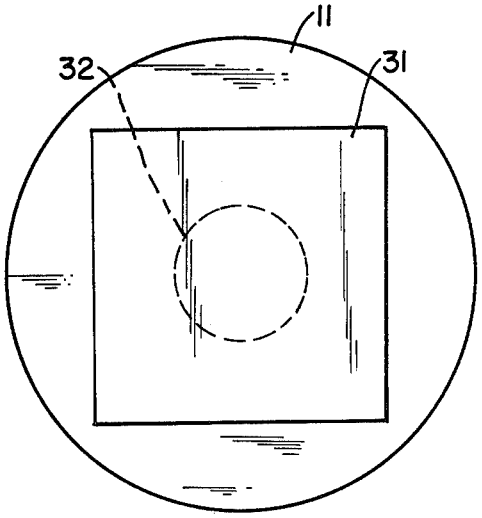
FIG. 3 is a bottom plan view.
Figure 4:
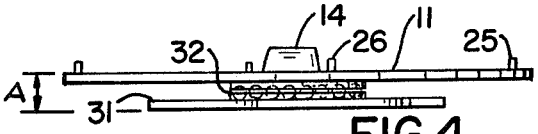
FIG. 4 is a side elevational view depicting a base and turntable assembly of the display rack.

Referring to FIG. 3, the turntable 11 is rotably attached to a rectangular base or support 31 and is coupled to the base 31 by means of a circular ball bearing plate 32. Plates as 32 are conventionally available and allow the turntable 11 to rotate with respect to the base 31. This is particularly shown in FIG. 4. The unit thus depicted is extremely simple to fabricate and has great utility in supporting and storing flat articles such as record albums or magazines.

In the embodiments shown, the cylinder 12 is fabricated from a clear plastic and is circular in cross-section but it is understood that any other geometrical configuration could be employed as well.

Figure 5:
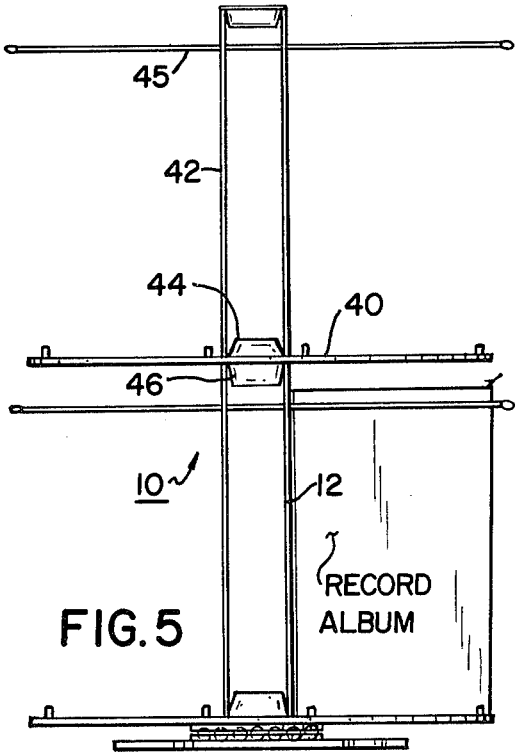
FIG. 5 is a side view of a stacking arrangement for the display rack.

Referring to FIG. 5, there is shown a rack assembly as depicted in FIGS. 1 and 2 with the opened top of the cylinder 12 accommodating another circular plate 40 having an associated cylinder 42 positioned on a hub 44 with associated rods as 45 projecting through apertures in the cylinder. The circular plate 40 is of the same shape and configuration as the turntable 11 but has depending from the bottom side a circular hub 46 which is inserted into the top opening of the cylinder 12. Hence as can be seen from FIG. 5, one rack device as 10 can be stacked upon another in the simple manner shown to therefore enable a user to hold and store greater number of records.

Figure 6:
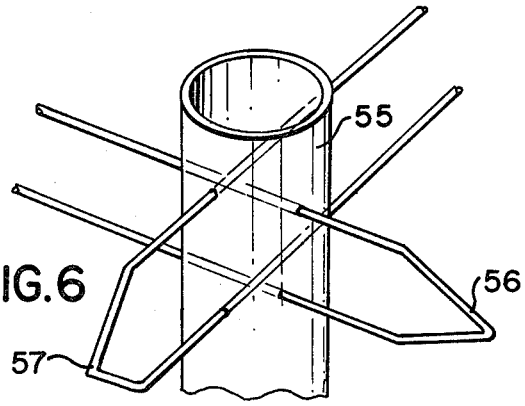
FIG. 6 is a partial perspective view depicting an alternate rod configuration for use with the display rack.

Referring to FIG. 6, there is shown an alternate embodiment depicting a series of "V" shaped rods as 50 and 51 directed through corresponding apertures in a cylindrical member 55. In the embodiment shown in FIG. 6, one can eliminate the support posts as each rod section provides a top and a bottom support surface for the record album.

As indicated above, the rotary display rack is extremely simple to use and to assemble. Thus, the entire unit can be easily manufactured and shipped.

In the construction of the device as shown in FIGS. 1 and 2, the following dimensions were employed to hold LP record albums: The diameter of the turntable 11 was approximately 24". The outer diameter of the cylinder 12 was approximately 3¼" having an inner diameter of 3". The height of the cylinder 12 from top to bottom is about 12" with the apertures located about 10" from the surface of the turntable. The back posts 26 were positioned about a circle 1" from the outer edge of the cylinder 12. The outer or front posts 25 were also positioned about a circle about 1" from the outer edge of the turntable 11. The length of each rod is between 28 to 30" and of a diameter of about ¼". The rods as shown in FIG. 2 are positioned so that the bottom rod as rod 22 is about ⅜" below rod 21 and so on.

It is of course understood that the three rods can actually contact one another at their outer periphery as the pairs of holes or apertures which accomodate the rods are predrilled at the factory. The height of each post is ½" and separation between the posts was approximately 8".

As indicated above, the posts are tacks which have an elongated plastic heads. The unit depicted above can accomodate over 100 record albums which are positioned in the compartments as shown in FIGS. 1 and 5. The user merely rotates the turntable by grasping the extending portions of the rod and can select an album during this procedure as the album faces are visible at the periphery end of the turntable as further shown in FIG. 1.

I claim:

1. A rotary display rack for storing record albums, comprising:

(a) a base, (b) a turntable rotatably carried by the base, (c) a central vertically extending longitudinal tubular member of a smaller area than said turntable affixed to said turntable said tubular member having a plurality of pairs of side apertures wherein each pair consists of one aperture in a first side and a second aperture aligned with the first in a second side, (d) a plurality of equal length rods each separately inserted through an associated pair of apertures with the length of said rods being such that they extend symmetrically from both sides of said tubular member to form a series of compartments about said turntable, and (e) means located about the surface of said turntable within the area of each compartment to serve as a bottom restraint for an album emplaced vertically on said turntable and retained relatively vertically by said rod at a top end and by said means at a bottom end.

2. The rotary display rack according to claim 1 wherein said turntable is a relatively flat circular member.

3. The rotary display rack according to claim 1 wherein said central longitudinal tubular member is a cylinder having an open top and an open bottom, a projecting circular member mounted centrally on said turntable and having a diameter to allow said opened bottom of said cylinder to be emplaced thereon to retain said cylinder in said vertical position.

4. The rotary display rack according to claim 1 wherein each of said rods is of a longer length than the diameter of said turntable to enable said rods to be accessed to rotate said turntable as desired.

5. The rotary display rack according to claim 1 wherein said means located about the surface of said turntable are a plurality of upstanding posts each of a much smaller height as compared to the height of said cylinder.

6. The rotary display rack according to claim 5 wherein said posts are arranged in pairs with a first post positioned on said turntable beneath an associated rod section and near the periphery, and a second post positioned along the same diameter as said post and located a fixed distance from the edge of said tubular member.

7. The rotary display rack according to claim 3 wherein said cylinder is fabricated from a clear plastic.

8. The rotary display rack according to claim 1 wherein said rods are three in number each located within said associated pair of apertures to form six compartments with said rods separated one from the other by sixty degrees.

9. The rotary display rack according to claim 3 further comprising another circular member positioned within the top opening of said cylinder.

10. The rotary display rack according to claim 9 wherein said circular member is a second flat circular member relatively congruent to said turntable and having a centrally extending tubular member with projecting rods to allow storage of additional record albums.

* * * * *